US009023180B2

(12) United States Patent
Hadejiri

(10) Patent No.: US 9,023,180 B2
(45) **Date of Patent: *May 5, 2015**

(54) METHOD AND APPARATUS FOR PRODUCING PRODUCT FROM STOCK PULP SHEET

(71) Applicant: Uni-Charm Corporation, Ehime (JP)

(72) Inventor: Hitoshi Hadejiri, Kagawa (JP)

(73) Assignee: Unicharm Corporation, Ehime (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/785,076

(22) Filed: Mar. 5, 2013

(65) Prior Publication Data

US 2014/0008029 A1 Jan. 9, 2014

Related U.S. Application Data

(63) Continuation of application No. 13/392,964, filed as application No. PCT/JP2010/062977 on Jul. 26, 2010, now Pat. No. 8,388,810.

(30) Foreign Application Priority Data

Aug. 28, 2009 (JP) ..... 2009-198241

(51) Int. Cl.

| | |
|---|---|
| ***D21F 11/00*** | (2006.01) |
| ***D21F 13/00*** | (2006.01) |
| ***D04H 1/26*** | (2012.01) |
| ***D04H 1/425*** | (2012.01) |
| ***D04H 1/4274*** | (2012.01) |
| ***D21C 9/08*** | (2006.01) |
| ***D21D 1/32*** | (2006.01) |

(52) U.S. Cl.

CPC ..... *D21F 13/00* (2013.01); *D04H 1/26* (2013.01); *D04H 1/425* (2013.01); *D04H 1/4274* (2013.01); *D21C 9/08* (2013.01); *D21D 1/32* (2013.01)

(58) Field of Classification Search

USPC ..... 162/194, 260, 261, 263

See application file for complete search history.

(56) References Cited

U.S. PATENT DOCUMENTS

| | | | | |
|---|---|---|---|---|
| 4,897,159 | A | 1/1990 | Bone et al. | |
| 5,498,478 | A | 3/1996 | Hansen et al. | |
| 8,388,810 | B2 * | 3/2013 | Hadejiri | 162/194 |

FOREIGN PATENT DOCUMENTS

| | | | |
|---|---|---|---|
| JP | 63-295946 | A | 12/1988 |
| JP | 3-140849 | A | 6/1991 |
| JP | 5-312551 | A | 11/1993 |
| JP | 2002-79187 | A | 3/2002 |
| WO | WO 03/059093 | A1 | 7/2003 |

OTHER PUBLICATIONS

International Search Report from corresponding PCT application No. PCT/JP2010/062977 dated Sep. 14, 2010, 3 pgs.

European Search Report from corresponding EP application No. 10811656.7 dated Jan. 7, 2013 (6 pgs).

* cited by examiner

*Primary Examiner* — Mark Halpern

(74) *Attorney, Agent, or Firm* — Brinks Gilson & Lione

(57) ABSTRACT

A method of production of a product from a stock pulp sheet uses conveyor rolls to convey a stock pulp sheet to a crusher. During conveyance to the crusher, a defective part in the stock pulp sheet is detected by a detector. The detected defective part is removed from the stock pulp sheet by a remover. The stock pulp sheet from which the defective part is removed is supplied to the crusher to produce crushed pulp. The produced crushed pulp is used to produce a product in a product producer.

4 Claims, 5 Drawing Sheets

METHOD AND APPARATUS FOR PRODUCING PRODUCT FROM STOCK PULP SHEET

RELATED APPLICATION

This application is continuation of U.S. patent application Ser. No. 13/392,964, filed Feb. 28, 2012 to which priority is claimed under 35 U.S.C. §120, which is a 35 U.S.C. §371 national phase filing of International Patent Application No. PCT/JP2010/062977, filed Jul. 26, 2010, through which and to which priority is claimed under 35 U.S.C. §119 to Japanese Patent Application No. 2009-198241, filed Aug. 28, 2009.

TECHNICAL FIELD

The present invention relates to a method and apparatus for producing a product from a stock pulp sheet.

BACKGROUND ART

In the past, the method has been known of crushing a stock pulp sheet by a crusher to produce crushed pulp, forming component parts such as a nonwoven fabric or absorbent mat from the produced crushed pulp, and assembling these component parts to produce a product such as a disposable diaper or sanitary napkin.

In this regard, a stock pulp sheet sometimes includes a defective part where for example a piece of bark or other foreign matter is mixed in or changes color. If such a defective part for example remains at the surface in contact with the skin such as the top sheet, the commercial value of the product will end up falling.

Therefore, a defective product rejection system which detects a defective part present in a product and rejects a product containing the defective part as a defective product is known (see PLT 1).

CITATION LIST

Patent Literature

PLT 1: Japanese Unexamined Patent Publication No. 2002-79187

SUMMARY OF INVENTION

Technical Problem

A defective product rejected as explained above is generally discarded. However, it is uneconomical to discard an entire product if the defective part is just minor.

In this regard, if detecting and removing the defective part at the stage of the stock pulp sheet, this problem could be resolved. In this regard, a stock pulp sheet is conveyed toward a crusher at a considerably fast speed. Further, a defective part is sometimes present not at the surface of the stock pulp sheet, but inside it, and the basis weight of a stock pulp sheet is considerably high. For this reason, at the present time it is considered difficult to reliably detect and remove a defective part in a stock pulp sheet and, at the product stage, the defective part is detected and the entire product is discarded. If temporarily stopping the conveyance of a stock pulp sheet to the crusher, it would be possible to reliably detect and remove a defective part, but if doing this, the productivity of the product may be liable to remarkably drop.

Solution to Problem

According to one aspect of the present invention, there is provided a method of producing a product from a stock pulp sheet, comprising the steps of:

conveying the stock pulp sheet to a crusher, detecting a defective part in the stock pulp sheet by a detector during the conveyance to the crusher and removing the detected defective part from the stock pulp sheet by a remover, feeding the stock pulp sheet from which the defective part has been removed into the crusher to produce crushed pulp, and using the produced crushed pulp to produce a product.

According to another aspect of the present invention, there is provided an apparatus for producing a product from a stock pulp sheet, comprising a crusher which crushes the stock pulp sheet to produce crushed pulp, a conveyor which conveys the stock pulp sheet toward the crusher, a detector which detects a defective part in the stock pulp sheets during conveyance to the crusher, a remover which removes from the stock pulp sheet the detected defective part detected during conveyance to the crusher, and a producer which uses the produced crushed pulp to produce a product.

Advantageous Effects of Invention

It is possible to produce a product with a high economy and productivity while reliably detecting and removing a defective part.

DESCRIPTION OF EMBODIMENTS

Figure 1:
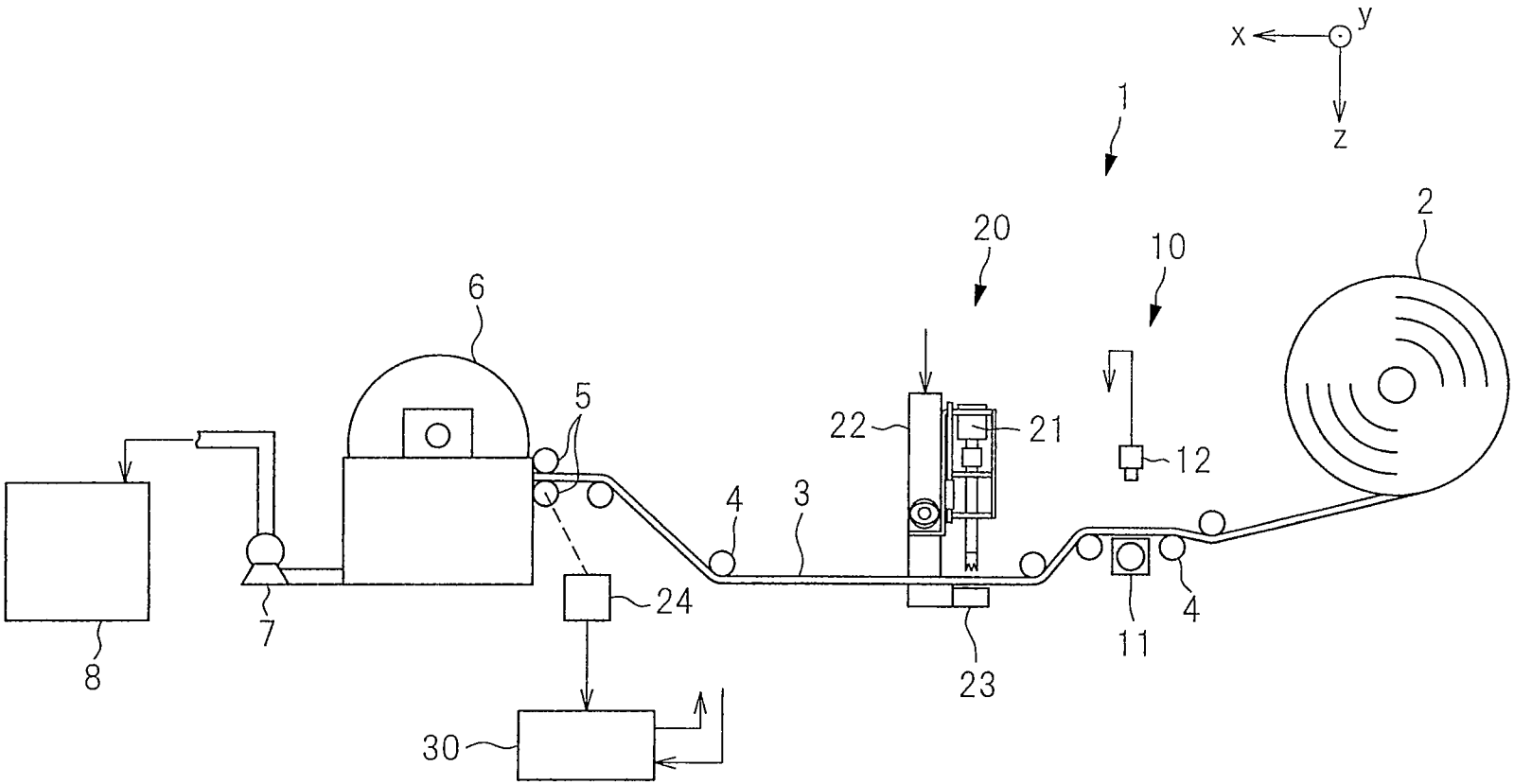
FIG. 1 is an overview of a production apparatus.

FIG. 1 shows an apparatus 1 for producing a product from a stock pulp sheet. Here, the stock pulp sheet is produced by shaping pulp made from wood, a nonwood material, recycled paper, synthetic fibers, etc. into a sheet and drying the result.

In the production apparatus 1 shown in FIG. 1, the stock pulp sheet is prepared in the form of a roll 2. The stock pulp sheet 3 unwound from the roll 2 is guided by a plurality of guide rolls 4 and conveyed by a pair of conveyor rolls 5 to a crusher 6.

Upstream of the crusher 6, that is, between the roll 2 and the crusher 6, a detector 10 is provided for detecting a defective part in the stock pulp sheet 3. The detector 10 is provided with a light source 11 arranged at one side of the stock pulp sheet 3 and a camera 12 arranged at the other side of the stock pulp sheet 3. The light source 11 emits light to the stock pulp sheet 3. The transmitted light obtained at the other side of the stock pulp sheet 3 at that time is obtained by the camera 12. Note that, it is also possible to provide a plurality of cameras 12 arranged in a width direction of the stock pulp sheet 3.

Further, downstream of the detector 10, that is, between the detector 10 and the crusher 6, a remover 20 is provided for removing a defective part detected by the detector 10 from the stock pulp sheet 3. The remover 20 is provided with a cutout device 21 provided at one side of the stock pulp sheet 3 for cutting out a defective part from the stock pulp sheet 3, a mover 22 for making the cutout device 21 move in the x-, y-, and z-directions, a pickup device 23 provided at the other side of the stock pulp sheet 3 for picking up a defective part cut out from the stock pulp sheet 3, and a distance detector 24 for detecting a conveyance distance of the stock pulp sheet 3. Note that, x, y, and z indicate the conveyance direction, width direction, and thickness direction of the stock pulp sheet 3 around the remover 20, respectively. In the example shown in FIG. 1, the x-and y-directions are substantially horizontal and the z-direction is substantially vertical.

Figure 2:
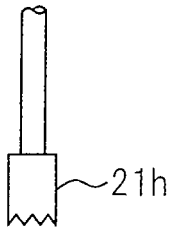
FIG. 2 is a partial front view of a hole saw.

The cutout device 21 is provided with a rotary blade and a drive device for driving rotation of the rotary blade. This rotary blade is for example comprised of a hole saw 21*h* such as shown in FIG. 2. The diameter of the hole saw 21*h* is set in accordance with the size of the defective part to be removed. Note that, the rotary blade can also be comprised of a compass type rotary cutter.

Figure 3:
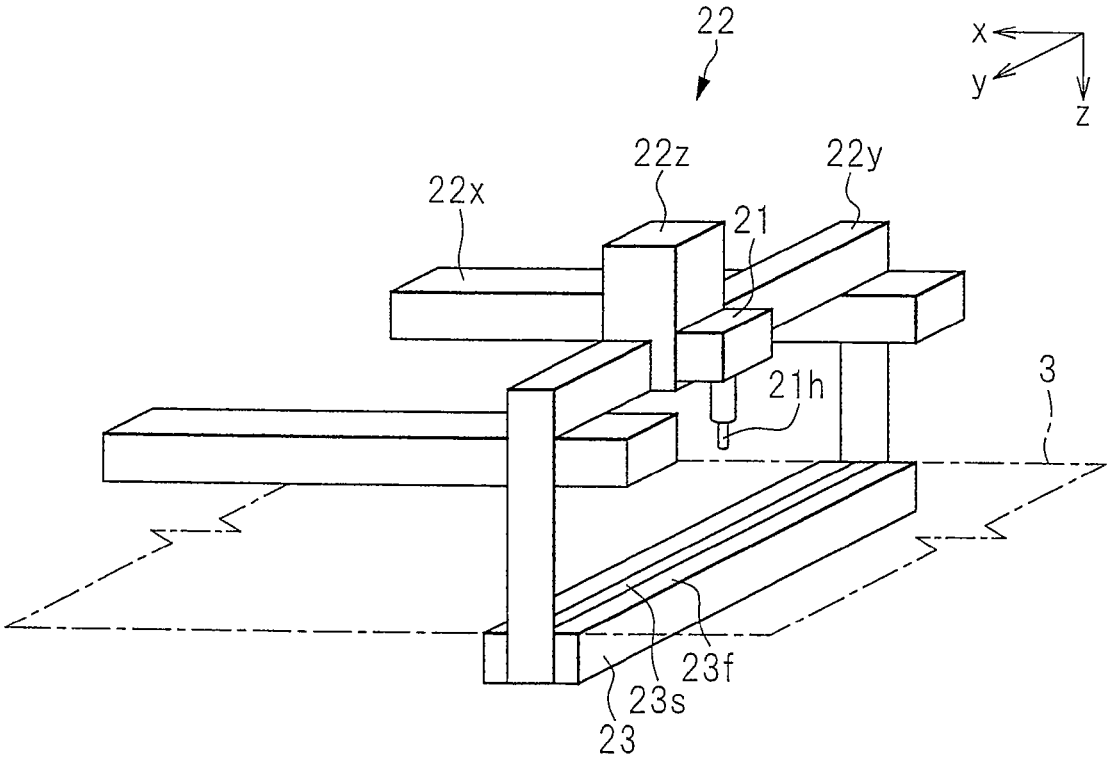
FIG. 3 is a schematic perspective view of a mover.

The mover 22, as shown in FIG. 3, is provided with an x-direction mover 22x extending in the x-direction, a y-direction mover 22y extending in the y-direction, and a z-direction mover 22z extending in the z-direction. The x-direction mover 22x carries the y-direction mover 22y and makes it move in the x-direction, the y-direction mover 22y carries the z-direction mover 22z and makes it move in the y-direction, and the z-direction mover 22z carries the cutout device 21 and makes it move in the z-direction. In this way, the cutout device 21 or hole saw 21*h* can move in three dimensions.

The pickup device 23 is for example connected to the y-direction mover 22y. Therefore, it can move together with the cutout device 21 in the x-direction. At the top surface of the pickup device 23 positioned approximately right under the hole saw 21*h*, a suction slit 23*s* is formed. This suction slit 23*s* is given a negative pressure. That is, in the example shown in FIG. 1, the pickup device 23 picks up the removed detective part by a suction action.

Further, flat areas 23*f* are formed at the upstream side and downstream side of the suction slit 23*s* at the top surface of the pickup device 23. The stock pulp sheet 3 is moved over these flat areas 23*f* and therefore conveyed while being supported by these flat areas 23*f*.

Referring again to FIG. 1, the distance detector 24 is provided with a rotary encoder for example built into the conveyor rollers 5. The rotary encoder 24 generates an output pulse corresponding to the amount of rotation of the conveyor rollers 5. The amount of rotation of the conveyor rollers 5 expresses the distance of conveyance of the stock pulp sheet 3 and the distance of movement of a defective part.

The outputs of the camera 12 and rotary encoder 24 are input to the input side of a computer 30. The output side of the computer 30 is connected to the cutout device 21 and mover 22.

The computer 30 detects a defective part in the stock pulp sheet 3 based on the transmitted light obtained by the camera 12. That is, it compares the intensity of the transmitted light obtained by the camera 12 with a predetermined threshold value, judges a part with an intensity of the transmitted light smaller than the threshold value as a defective part, and judges other parts as not defective parts. By doing this, it is possible to simultaneously and easily detect defective parts which can exist at the two surfaces and inside of the stock pulp sheet 3.

Note that the white pieces of pulp which can be included in a stock pulp sheet 3 and regions with remarkably uneven basis weight can be detected using the above detector 10.

When a defective part in the stock pulp sheet 3 is detected, the hole saw 21*h* is made to move by the mover 22 to the defective part. In this case, the x-direction position and y-direction position of the defective part are identified from the output of the rotary encoder 24 and the output of the camera 12.

Figure 4A:
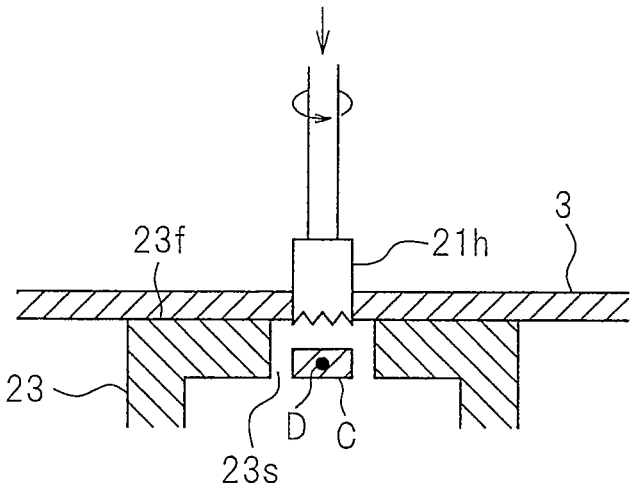
FIG. 4A is a view explaining the action of removal of a defective part.
Figure 4B:
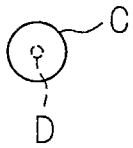
FIG. 4B is a plan view of a circular region.

Next, the hole saw 21*h* is driven to rotate while being made to descend in the z-direction. As a result, as shown in FIGS. 4A and 4B, a circular region C including the defective part D is cut out from the stock pulp sheet 3 by the hole saw 21*h*. The cut out circular region C is sucked into the suction slit 23*s*.

In this case, the hole saw 21*h* is made to move in synchronization with the conveyed stock pulp sheet 3, in particular the defective part D, while removing the defective part D. That is, during removal of the defective part D, the hole saw 21*h* is made to move at substantially the same speed as the defective part D in the x-direction or the conveyance direction. As a result, the defective part D is removed without stopping the stock pulp sheet 3 and in particular without slowing the stock pulp sheet 3. Therefore, the detection and removal of a defective part do not cause the processing ability of the stock pulp sheet 3 to drop.

Further, the pickup device 23 is also moved synchronously with the defective part D. As a result, as shown in FIG. 4A, when the hole saw 21*h* cuts out the defective part D or circular region C, the stock pulp sheet 3 around the defective part D is supported by the flat areas 23*f* of the pickup device 23. Therefore, it becomes possible to stably and easily cut out the defective part D or circular region C.

When the defective part D is removed, the hole saw 21*h* is raised to separate it from the stock pulp sheet 3 and then returned to its initial position.

Referring again to FIG. 1, the stock pulp sheet from which the defective part D has been removed is next fed to the crusher 6. In the example shown in FIG. 1, the crusher 6 is provided with a hammer mill. The crusher 6 crushes the stock pulp sheet 2 by the hammer mill and produces crushed pulp or fluff pulp. The crushed pulp is next conveyed by a conveyor fan 7 to a product producer 8.

The product producer 8 uses the crushed pulp to produce a product. Here, the product includes a nonwoven fabric used for wipes, cleaning sheets, etc., absorbent articles such as sanitary napkins and disposable diapers, paper, etc. When the product is an absorbent article, the component elements of the absorbent article such as the fluff pulp mat is also produced by the product producer 8.

In this case, since the defective part is removed from the stock pulp sheet 3, the crushed pulp contains almost no defective parts. Therefore, the product also contains almost no defective parts. As a result, there are almost no more products which are discarded due to the inclusion of a defective part, so the manufacturing costs of the present invention is greatly lowered.

Further, when directly producing a fluff pulp mat from crushed pulp produced using a hammer mill, making the basis weight of the fluff pulp mat uniform requires the continuous supply of stock pulp sheet 3 to the crusher 6. In the embodiment according to the present invention, the stock pulp sheet 3 can be supplied to the crusher 6 without the sheet being stopped, so the basis weight of the fluff pulp mat can be made uniform.

Figure 5:
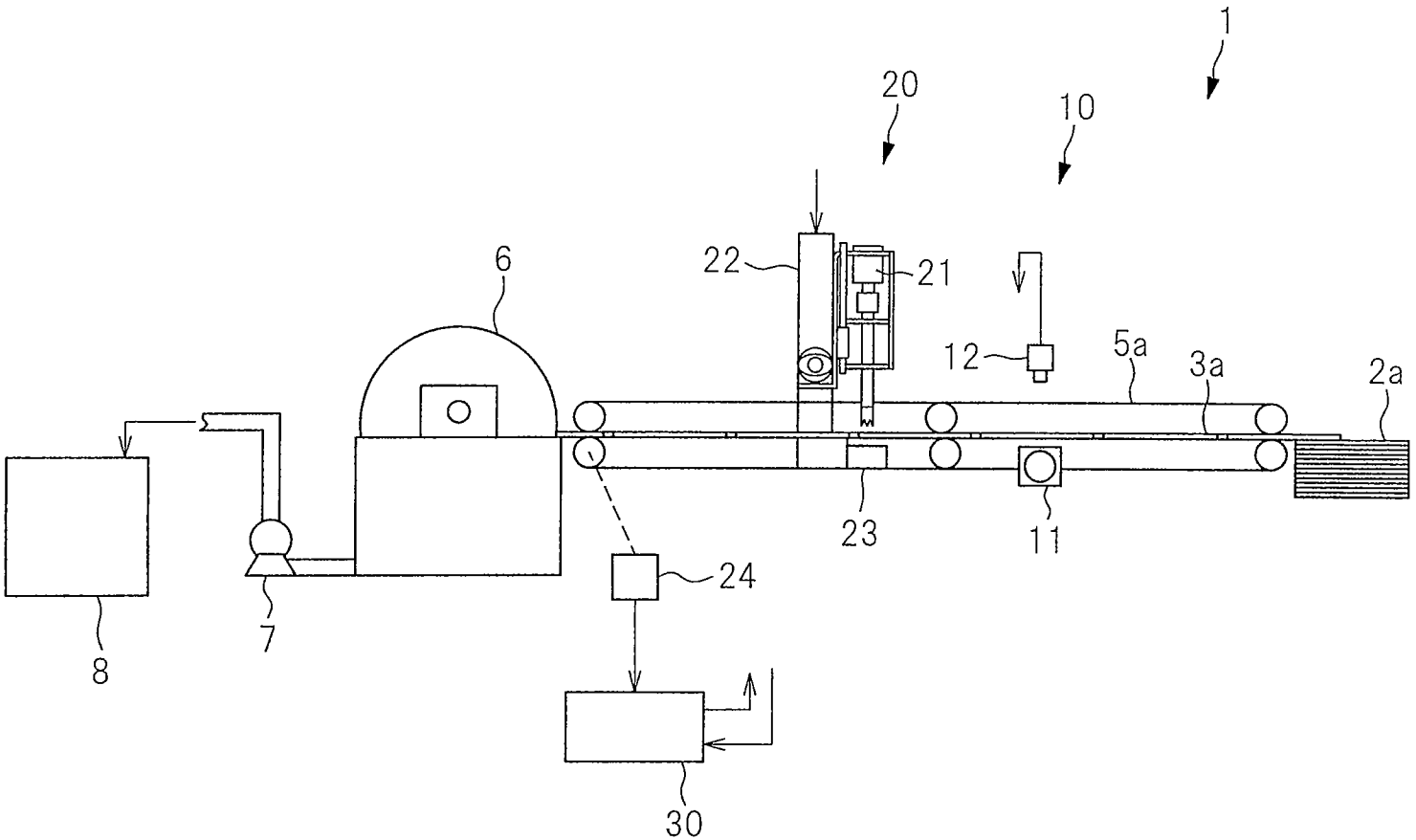
FIG. 5 is a view of another example of a production apparatus.

In the embodiments of the present invention discussed up to here, the stock pulp sheet 3 is fed to the crusher 6 in the form of a continuous web unwound from a roll 2. However, as shown in FIG. 5, it is also possible to prepare a stack 2*a* of separate square-shaped stock pulp sheets 3*a* and successively feed the stock pulp sheets 3*a* from the stack 2*a* by a conveyor belt 5*a*. In this case, the conveyor belt 5*a* conveys the stock pulp sheets 3*a* with two side edges gripped. Further, a rotary encoder 24 is incorporated in a roller of the conveyor belt 5*a*.

Note that, in the example shown in FIG. 5, the stock pulp sheets 5*a* are conveyed separated from each other. In this case, by providing a reservoir which temporarily stores the crushed pulp between the crusher 6 and the product producer 8, it is possible to give a fluff pulp mat a uniform basis weight. However, with the direct connection system not using a reservoir, it is also possible to have the rear end of a preceding stock pulp sheet 5*a* and the front end of a succeeding stock pulp sheet 5*a* be contiguous.

Figure 6:
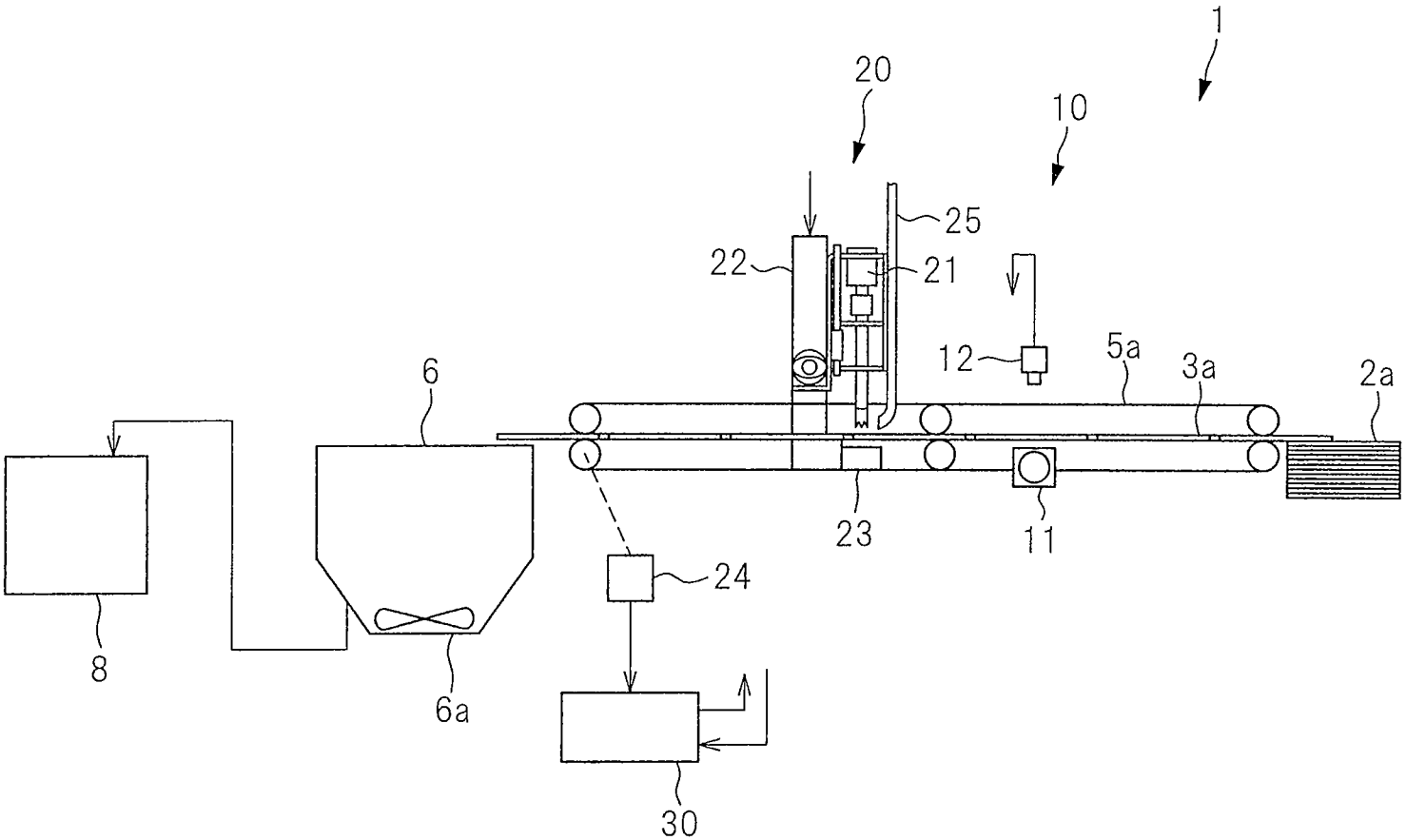
FIG. 6 is a view of still another example of a production apparatus.

Alternatively, when producing a nonwoven fabric or paper, as shown in FIG. 6, the crusher 6 may also be provided with a pulper 6*a*. In this case, the crushed pump produced by the pulper 6*a* is fed to the product producer 8 in the form of a slurry.

Further, as shown in FIG. 6, it is also possible to provide a scrap remover 25 which uses for example a suction action to remove the scraps produced when the cutout device 21 cuts out a defective part. This scrap remover 25 may for example be fastened to the cutout device 21 and therefore move together with the cutout device 21.

Furthermore, in the embodiments of the present invention discussed up to here, one detector 10 and one remover 20 each were provided. However, a plurality of detectors 10 and removers 20 may also be provided. If doing this, it is possible to reliably detect and remove a defective part.

When providing a plurality of detectors 10, these detectors 10 may for example be arranged serially in the direction of conveyance of the stock pulp sheet 3. Further, it is also possible to have a certain detector 10 emit light from one side of the stock pulp sheet 10 and receive the transmitted light at the other side and have another detector 10 emit light from the other side of the stock pulp sheet 10 and receive the transmitted light at the one side. Alternatively, it is also possible to make the light intensity of the light source 11 or the dimensions of the defective part to be detected different for each detector 10. Whatever the case, if doing this, it is possible to more reliably detect a defective part.

Furthermore, in the embodiments of the present invention discussed up to here, the remover 20 was provided with a hole saw 21*h* to cut out the defective part from the stock pulp sheet. However, the remover 20 may also be provided with a die cutter to punch out the defective part from the stock pulp sheet. However, the basis weight of the stock pulp sheet is for example 680 g/m$^2$ or considerably high, so to reliably punch out a defective part, the remover 20 becomes considerably heavy. For this reason, making the remover 20 move in synchronization with the defective part becomes difficult. As opposed to this, with the hole saw 21*h*, such a problem does not arise.

Note that, the embodiments explained up to here can also be combined with each other. That is, for example, in the example of FIG. 1 or FIG. 2, the scrap remover 25 can also be provided.

REFERENCE SIGNS LIST

1 apparatus
3 stock pulp sheet
5 conveyor roll
6 crusher
8 product producer
10 detector
20 remover

The invention claimed is:

1. A method of producing a product which is a nonwoven fabric used for wipes or cleaning sheets from a stock pulp sheet, comprising the steps of:

conveying the stock pulp sheet to a crusher, detecting a defective part in the stock pulp sheet by a detector while continuously conveying the stock pulp sheet to the crusher and removing the detected defective part from the stock pulp sheet by a movable remover while continuously conveying the stock pulp sheet to the crusher, feeding the stock pulp sheet from which the defective part has been removed into the crusher to produce crushed pulp, and using the produced crushed pulp to produce a product which is a nonwoven fabric used for wipes or cleaning sheets.

2. A method as set forth in claim 1, wherein said remover is provided with a rotary blade and said rotary blade cuts out a circular region including said defective part from the stock pulp sheet to remove the defective part from the stock pulp sheet.

3. A method as set forth in claim 1, which makes said remover moves in synchronization with the conveyed stock pulp sheet while using the remover to remove said defective part.

4. A method as set forth in claim 1, which detects said defective part based on a transmitted image obtained at another side of the stock pulp sheet when emitting light from one side of the stock pulp sheet.

* * * * *